US005172179A

United States Patent [19]

Tani et al.

[11] Patent Number: 5,172,179

[45] Date of Patent: Dec. 15, 1992

[54] IMAGE RECORDER WITH A PAPER BUNDLING DEVICE

[75] Inventors: Tatsuo Tani, Urayasu; Yasuaki Ishii, Ichikawa, both of Japan

[73] Assignee: Ricoh Company, Ltd., Tokyo, Japan

[21] Appl. No.: 646,425

[22] Filed: Jan. 28, 1991

[30] Foreign Application Priority Data

Jan. 29, 1990 [JP] Japan ..... 2-6112[U]
Jan. 30, 1990 [JP] Japan ..... 2-17710
Mar. 29, 1990 [JP] Japan ..... 2-84291

[51] Int. Cl.[5] ..... G03G 15/00
[52] U.S. Cl. ..... 355/324; 100/26; 270/58
[58] Field of Search ..... 355/324, 206, 205; 270/1.1, 37, 53, 58; 100/4, 25, 26, 33 PB

[56] References Cited

U.S. PATENT DOCUMENTS 3,701,314 10/1972 Tull, III ..... 100/4 X
4,523,750 6/1985 Hubler ..... 270/53
4,946,154 8/1990 Nakamura ..... 270/53
4,985,729 1/1991 Sampath et al. ..... 355/206
4,989,852 2/1991 Gunther, Jr. ..... 270/53 X

FOREIGN PATENT DOCUMENTS 7736355 5/1978 Fed. Rep. of Germany .
3325165 1/1984 Fed. Rep. of Germany .

*Primary Examiner*—Joan H. Pendegrass
*Attorney, Agent, or Firm*—Oblon, Spivak, McClelland, Maier & Neustadt

[57] ABSTRACT

An image recorder having a paper bundling device which bundles a stack of recording sheets sequentially driven out of a body of the recorder by using a strip. The recording operation of the image recorder is interrupted when recording sheets are left on a tray included in the bundling device, when the strip is short, or when a fault occurs in the strip.

11 Claims, 13 Drawing Sheets

IMAGE RECORDER WITH A PAPER BUNDLING DEVICE

BACKGROUND OF THE INVENTION

The present invention relates to a copier, facsimile transceiver, printer or similar image recorder and, more particularly, to an image recorder having a paper bundling device which belongs to a family of paper finishers.

A copier or similar image recorder, especially one which is required to operate at high speed, often has a finisher for sorting, binding or otherwise finishing paper sheets undergone recording operations to enhance rapid handling of a great amount of such paper sheets. For example, an image recorder with a sorter for sorting paper sheets copy by copy is disclosed in Japanese Utility Model Laid-Open Publication No. 121456/1986. An image recorder with a stapler for stapling paper sheets copy by copy is taught in Japanese Patent Laid-Open Publication Nos. 186278/1987 and 032471/1987. Recently, even an image recorder with a pasting device for pasting part of paper sheets or with a device for inserting extra paper sheets has been proposed.

However, an image recorder with a sorter cannot fasten paper sheets although it is capable of sorting them. An image recorder with a stapler is disadvantageous in that the number of paper sheets which can be stapled together is only a hundred or so, and in that staples used to bind them render the resultant stack bulky and, therefore, uneasy to handle or store. Further, the problem with an image recorder with a pasting device is that pasted paper sheets cannot be loosened afterwards and are, therefore, difficult to copy.

SUMMARY OF THE INVENTION

It is therefore an object of the present invention to provide an image recorder with a bundling device which bundles a stack of paper sheets driven out of a recorder body by using a strip.

It is another object of the present invention to provide an image recorder with a bundling device which promotes easy handling of a finished paper stack and allows it to be reproduced with ease.

An image recorder capable of bundling a stack of recording sheets each carrying an image thereon of the present invention comprises a recording section for recording images on recording sheets and discharging the recording sheets, a stacking section for stacking the recording sheets discharged from the recording section, a bundling section for bundling the recording sheets stacked by the stacking section by a strip, and a control section responsive to a bundle command for controlling a recording operation of the recording section and a bundling operation of the bundling section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
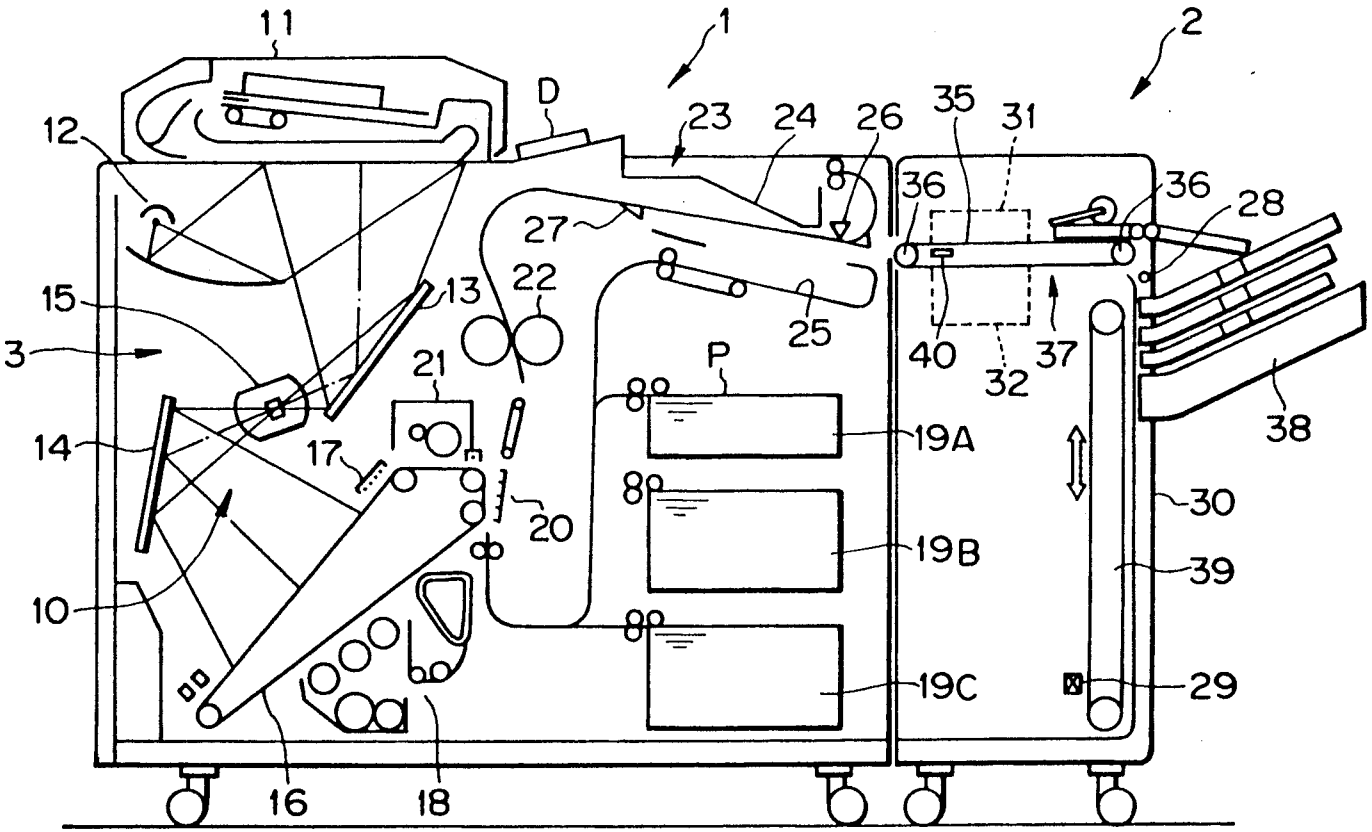
FIG. 1 is a section showing an image recorder with a paper bundling device embodying the present invention.
Figure 2:
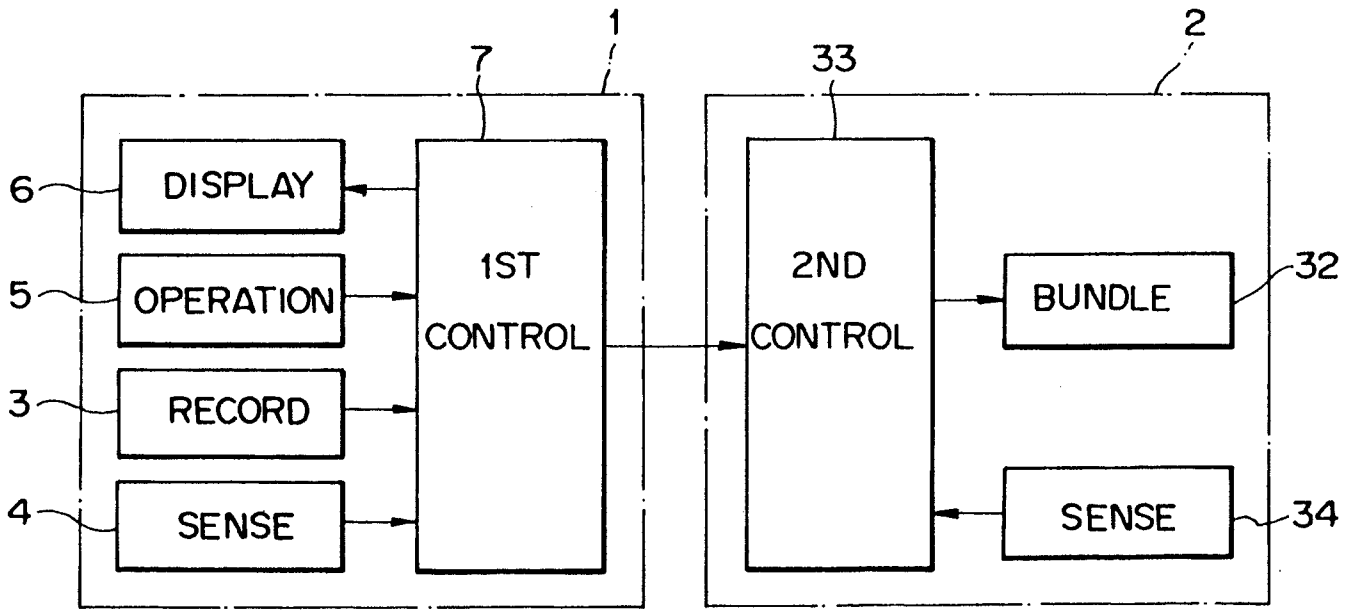
FIG. 2 is a block diagram schematically showing a control system of the illustrative embodiment.

Referring to FIGS. 1 and 2 of the drawings, an image recorder embodying the present invention is shown and implemented as a copier by way of example. As shown, the copier has a body 1 and a finisher in the form of a paper bundling device 2. The paper bundling device 2 adjoins the paper outlet side of the copier body 1.

The copier body 1 has a recording section 3 for recording an image on a paper sheet and then discharging it to the outside. A sensing section 4 has various sensors, not shown, incorporated in the recording section 3 and a sensor 26 which is responsive to the end of a recording operation as well as to a paper discharging operation, as will be described. An operating section 5 has a print button, numeral keys and other conventional user-oriented keys. A display section 6 displays numerical values entered on the operating section 5 and other necessary information. A first control section 7 controls various sections of the copier such as the sections 3 and 6 and outputs a bundle command which will be described. Including a microcomputer and a memory, the control section 7 outputs control signals in response to inputs on the operating section 5, outputs of the sensors, and outputs of a second control section 33, which will be described, according to a program stored in the memory.

The recording section 3 has an ADF (Automatic Document Feeder) 11 for feeding a stack of documents D one by one to a predetermined position. A lamp 12 illuminates the document D driven by the ADF 11 to the predetermined position. Mirrors 13 and 14 and a lens 15 constitute optics 10 in combination with the lamp 12. A photoconductive element in the form of a belt 16 is exposed imagewise by the optics 10. A main charger 17 uniformly charges the belt 16 to a predetermined polarity before the imagewise exposure. A developing unit 18 develops a latent image electrostatically formed on the belt 16 by the exposure. Paper feeding sections 19A, 19B and 19C each is loaded with paper sheets, or recording sheets, P and feeds them one by one toward the belt 16. An image transferring unit 20 transfers the image developed by the developing section 18 to a paper sheet P fed from any one of the paper feeding sections 19A to 19C. A cleaning unit 21 cleans the belt 16 undergone the image transfer. A fixing unit 22 fixes the image transferred from the belt 16 to the paper sheet P. A paper transport section 23 selectively steers the paper sheet carrying the image thereon either to a discharge path or to a refeed or two-sided copy path. In a one-side copy and non-bundle mode, the paper sheet P is driven out of the copier body 1 onto a tray 24. In a two-side copy mode, the paper sheet P carrying an image on one side thereof is transported to an intermediate tray 25. The sensor 26 is implemented as an optical sensor, for example, and senses the paper sheet P being discharged. A switching mechanism 27 selectively switches the paper discharge path either to the tray 24 side or to the finisher 2 side. When various copying conditions including paper size, magnification and desired number of copies are entered on the inputting section 5, the first control section 7 causes the recording section 3 into a sequence of image forming steps.

Figure 5:
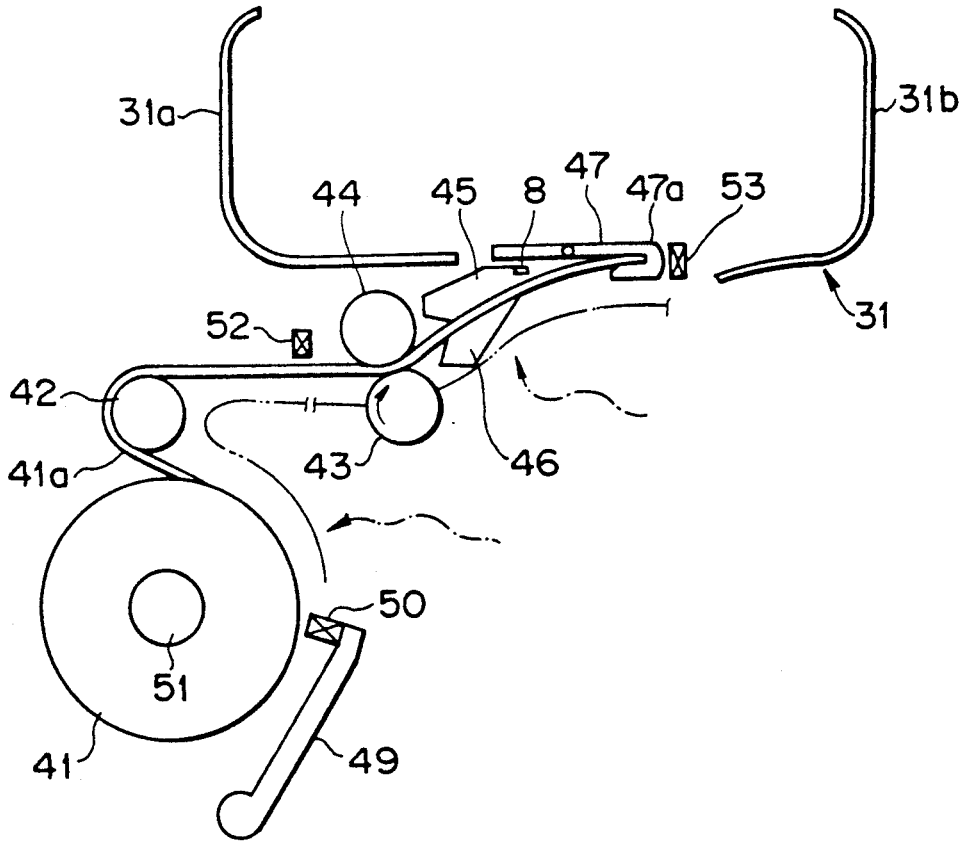

The paper bundling device, or finisher, 2 has a casing 30, a tray 31 for stacking the paper sheets, or copies, P which are sequentially driven out of the copier body 1. Tape guides 31*a* and 31*b* (see FIG. 3) are located at opposite sides of the tray 31. A bundling section 32 is located in close proximity to the tape guides 31*a* and 31*b* to bundle the paper sheets P stacked on the tray 31 by a strip. When the first control section, or bundle commanding means, 7 feeds a bundle command to the second control section 33, the control section 33 controls the operation of the bundling section 32 and, at the same time, controls the operation of the copier body 1 in cooperation with the control section 7. A transport belt 35 is passed over a pluality of drive rollers 36 and partly located in the tray 31. A transporting section 37 drives the rollers 36 to move the transport belt 35 to the right as viewed in FIG. 1. A tray 38 is mounted on the front end of the casing 30 with respect to the intended direction of movement of the transport belt 35. The tray 38 is movable up and down along guide rails by being driven by a drive belt 39. A paper sensor 40 is implemented by a reflection type photointerrupter, for example, and responsive to the paper sheets P stacked on the tray 31. Further provided in the paper bundling device 2 are a sensor 28 responsive to the paper sheets P driven out onto the tray 38, a home sensor 29 responsive to the home position of the tray 38. The transporting section 37 transports bundled paper sheets P to another place, i.e., the tray 38 and determines whether or not a bundle of paper sheets P has been transported without errors on the basis of the output of the sensor 40. The sensors 40, 28 and 29 constitute a sensing section 34 in cooperation with sensors 50, 52 and 53 (FIG. 5) which will be described. When paper bundles are sequentially stacked on the tray 38 until the uppermost paper sheet exceeds the level where the paper sensor 28 is located, the tray 38 is lowered to in turn lower the uppermost paper sheet below the sensor 28. After the maximum number of paper bundles, or copies, which the tray 38 can accommodate have been removed from the tray 38, the tray 38 is again raised to its home position.

As shown in FIGS. 3 to 7, the bundling section 32 has a tape roll 41 which is rotatably supported in the casing 30. The tape roll 41 is a specific form of an adhesive strip which is pasted on one side thereof. Specifically, an adhesive tape 41*a* of the tape roll 41 is passed over a tension roller 42, nipped between a drive roller 43 and a pinch roller 44 which in combination serve as tape payout and tightening means, moved by the drive roller 43 while being guided by an upper and lower guide 45 and 46, and retained by a clamp portion 47*c* of a clamper 47 at the end thereof. The clamper 47 has a pawl-like configuration and plays the role of looping means. The tape 41*a* may be implemented by a paper tape carrying an adhesive which softens when heated on one side thereof, or a resinous tape easy to adhere when heated. The guides 45 and 46 are movable in a reciprocating motion between two different positions which are indicated by solid lines and phantom lines in FIG. 4. The clamper 47 performs one full rotation in a direction indicated by an arrow in FIG. 4 to loop the tape 41*a* (see FIG. 6), while retaining the tape 41*a* in cooperation with the guide 45 which is in the raised position (phantom line position in FIG. 4).

Figure 3:
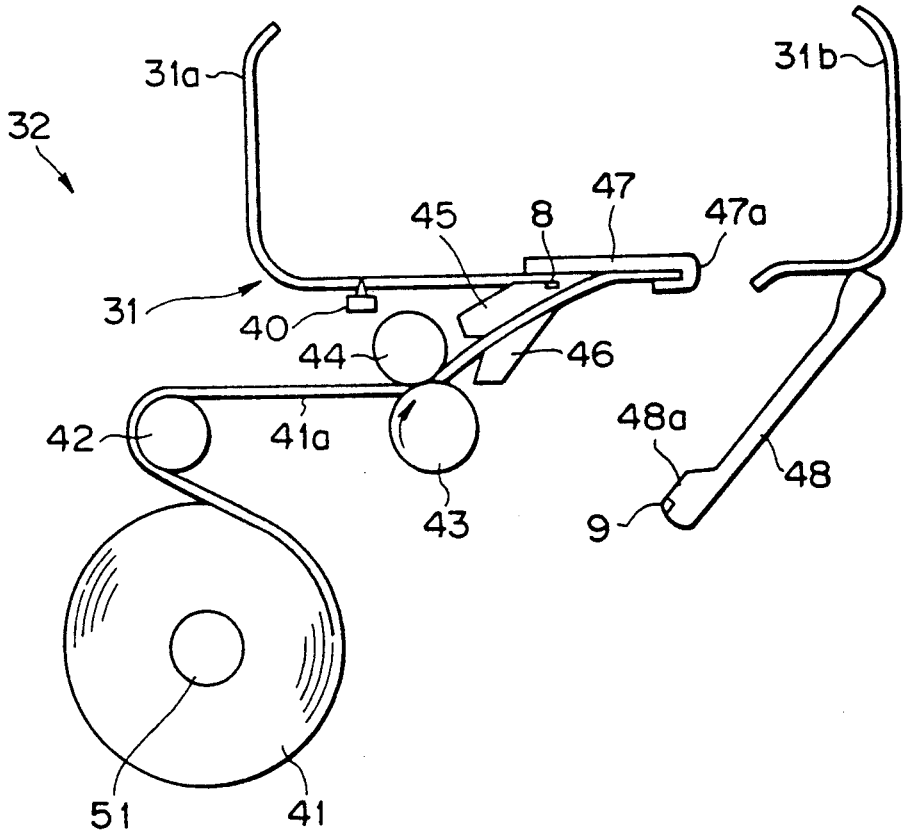
FIG. 3 is a section showing a specific construction of the paper bundling device.
Figure 4:
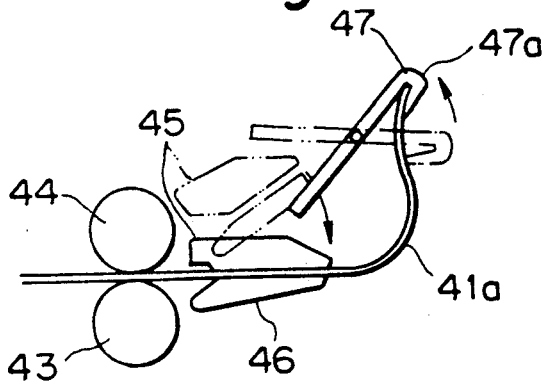
FIGS. 4 to 7 are fragmentary views demonstrating the operation of the paper bundling device.
Figure 7:
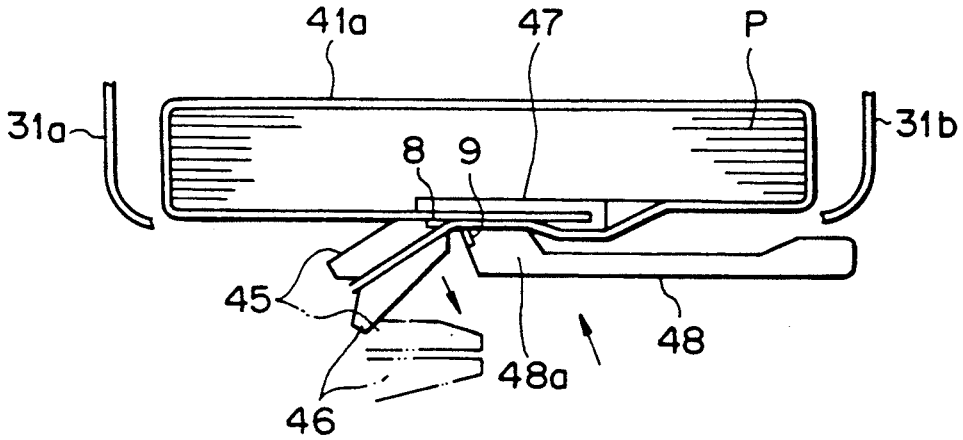

As shown in FIGS. 3 and 7, a heater 48 is rotatably supported in the casing 30 and serves as adhering means. The heater 48 has a heating portion 48*a* at the free end thereof for adhering part of the tape 41*a* by heat to form a loop. The guide 45 and the heater 48 have edge portions 8 and 9, respectively. The edge portion 9 cooperates with the edge portion 8 to cut the tape 41*a*. An arm 49 is also rotatably supported in the casing 30 and constantly biased toward the tape roll 41. A tape end sensor 50 is mounted on the free end of the arm 49 and movable toward the tape roll 41 in association with the pay-out of the tape 41*a* to detect the remaining amount of the tape 41*a*. Specifically, the tape end sensor 50 detects a tape near-end condition by sensing a reel shaft 51 which supports the tape roll 41. The output of the tape end sensor 50 is coupled to the second control section 33 together with the outputs of the sensors 52 and 53, FIG. 5. The sensors 52 and 53 are situated in close proximity to the path along which the tape 41*a* is fed. Specifically, the sensors 52 and 53 are responsive to the breakage or similar fault of the tape 41*a* which may occur in sections 1 and 2 shown in FIG. 5.

The control section 7 delivers the bundle command on the basis of AND of an end-of-record signal and an end-of-discharge signal which are outputted by the recoding sectin 3 and the sensing section 26, respectively, or on the basis of AND of the end-of-record signal and a paper sense signal from the sensor 40 of the sensing section 34. On the other hand, the control section 33 sends an operation stop command and a display request to the control section 7 in response to the output of the tape end sensor 50, causing it to display the shortage of the tape 41*a* on the display section 6. Then, the user may operate the copier body 1 only while seeing that the paper sheets will not be bundled. Further, in response to the outputs of he sensors 52 and 53, the control section 33 causes the control section 7 to display an error associated with the tape 41*a* and the place where it occurred.

Figure 8A:
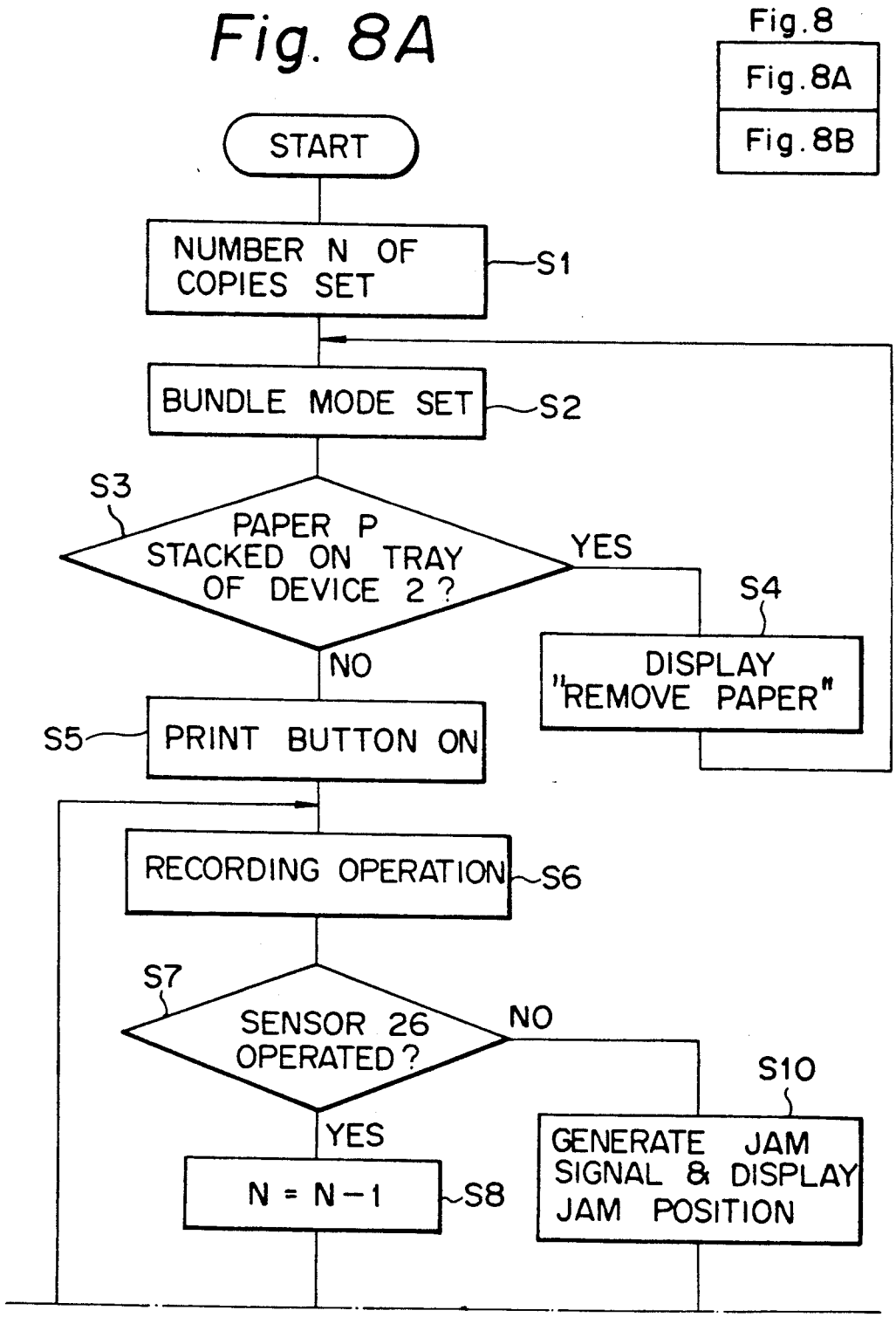
FIG. 8 is a flowchart representative of a specific operation of the control system.
Figure 8B:
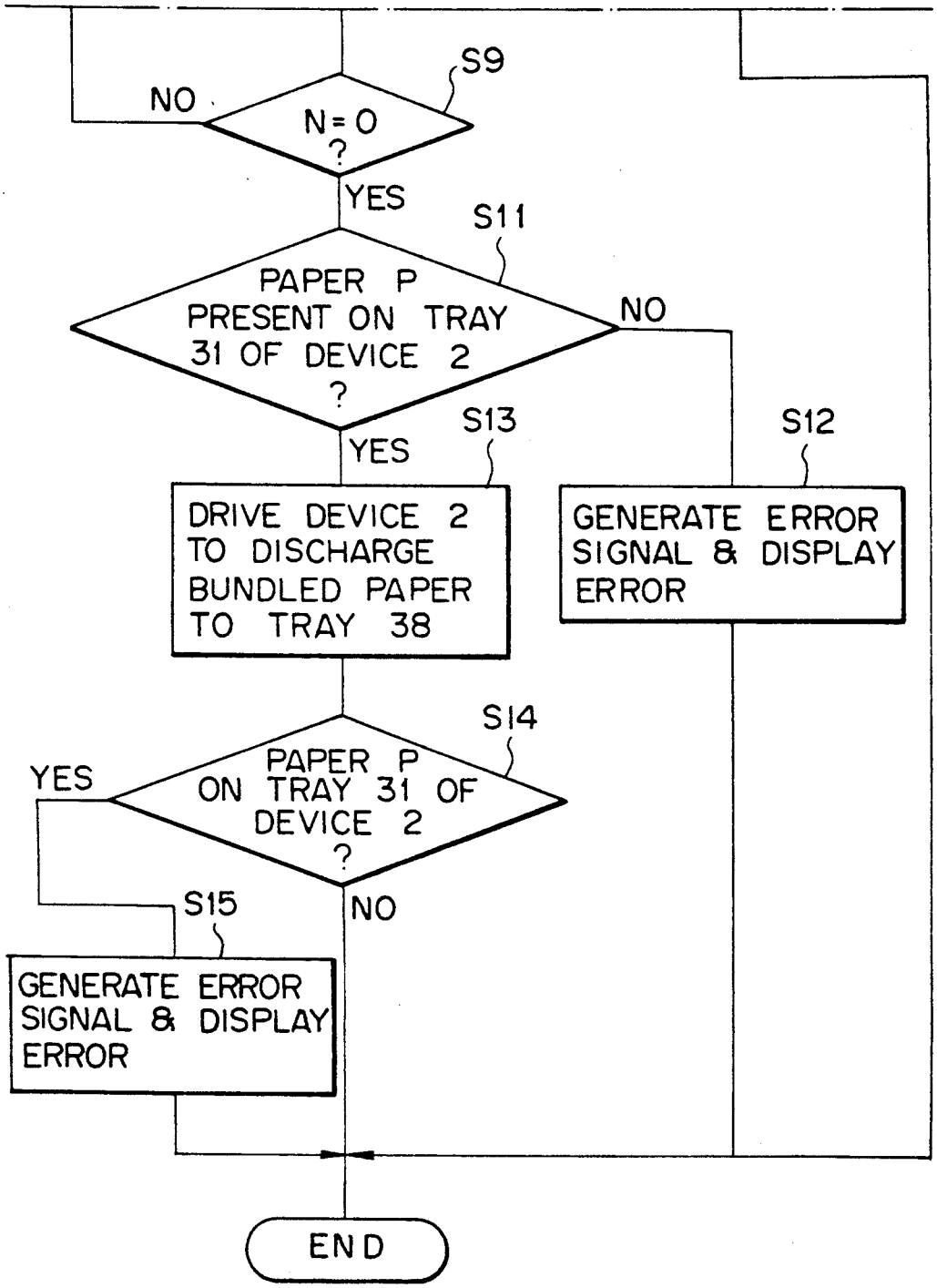

A specific operation of the control system shown in FIG. 2 will be described with reference to FIG. 8. As shown, the operator enters a desired number N of copies and a bundle mode on the operating section 5 (steps S1 and S2). In response, the control section 33 references the output of the sensor 40 of the sensing section 34 to see if paper sheets, or copies, P are present on the tray 31. Control signals representative of the result of decision, i.e., an operation stop comman and a display request are fed from the control section 33 to the control section 7. If paper sheets P are present on the tray 31, the control section 7 delivers a display command to the display section 6 to display a suitable message such as "REMOVE PAPER" (S4). Hence, when the control section 33 determines whether or not the tray 31 is loaded in response to the output of the sensor 40, the copier body 1 is held inoperative. On the other hand, if the tray 31 is not loaded with paper sheets P, the operator is urged to press the print button on the operating section 5 (S5). In response, the recording section 3 of the copier body 1 is driven to perform a sequence of image forming operations (S6). Then, whether or not a paper sheet has been driven out of the copier body 1 is determined on the basis of the output of the sensor 26 (S7). If the answer of the step S7 is YES, the set number of copies N is decremented (S8), and whether or not the resulted number N is zero is determined (S9). If the answer of the step S9 is NO, the program returns to the step S6. If a paper sheet has not been discharged as determined in the step S7, a jam signal is generated (S10) while the location where the jam has occurred is displayed. Then, the program ends.

Figure 6:
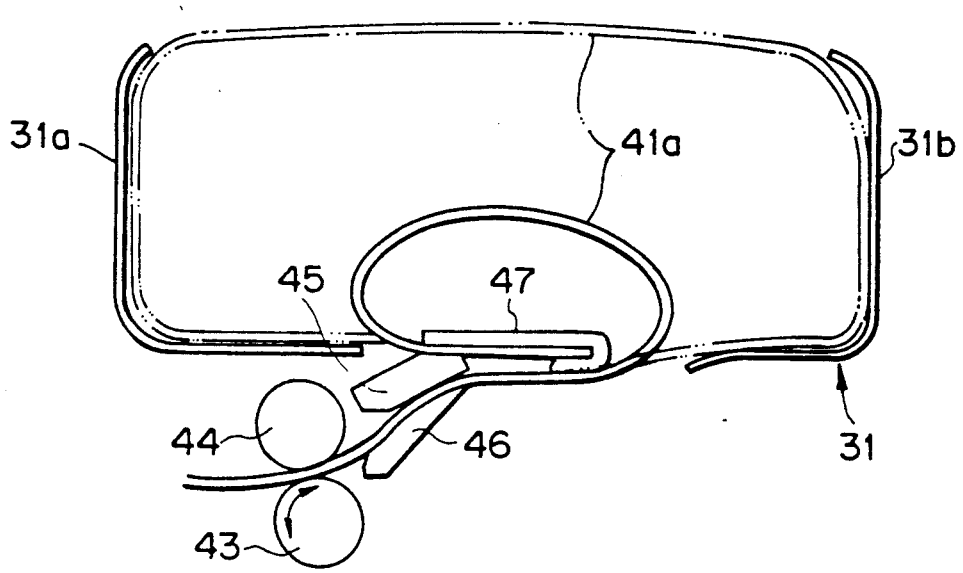

If the set number N of copies have been produced as determined in the step S9, whether or not recorded paper sheets P exist on the tray 31 is determined on the basis of the output of the sensor 40 (S11). If the answer of the step S11 is NO, an error signal is generated and the error is displayed on the display section 6 (S12). If the answer of the step S11 is YES, the control section 7 sends a bundle command to the control section 33 which in turn drives the bundling section 32. Specifically, the drive roller 43 is rotated to pay out the tape 41*a* toward the clamper 47, and the clamper 47 clamps it (see FIG. 3). Then, the clamper 47 is rotated counterclockwise as viewed in FIG. 3, whereby the tape 41*a* is looped, as shown in FIG. 6. As the drive roller 43 is further rotated, it continuously pays out the tape 41*a* with the result that the loop expands along the tape guides 31*a* and 31*b* to a position indicated by a phantom line in FIG. 6. Thereafter, the N paper sheets, or copies, P stacked on the tray 31 are slightly moved by the transporting section 37 until their leading end enters the loop of the tape 41*a*. Subsequently, the drive roller 43 is reversed to contract the loop of the tape 41*a*, as shown in FIG. 7. In this condition, the heater 48 presses, heats and thereby adheres the overlapping portions of the tape 41*a* to each other. At the same time, the edges 8 and 9 of the guide 45 and heater 48 cuts the tape 41*a*. As a result, the N paper sheets P are bundled up by the tape 41*a* and then transported toward the tray 38 by the transporting means 37. Whether or not such a paper bundle has left the tray 31 is determined on the basis of the output of the sensor 40 (S14). If the paper bundle still exists on the tray 31, the control section 33 sends an error signal to the control section 7 which then displays the error on the display section 6. If the answer of the step S14 is YES, meaning that the paper bundle has been successfully discharged, the program ends.

Figure 9:
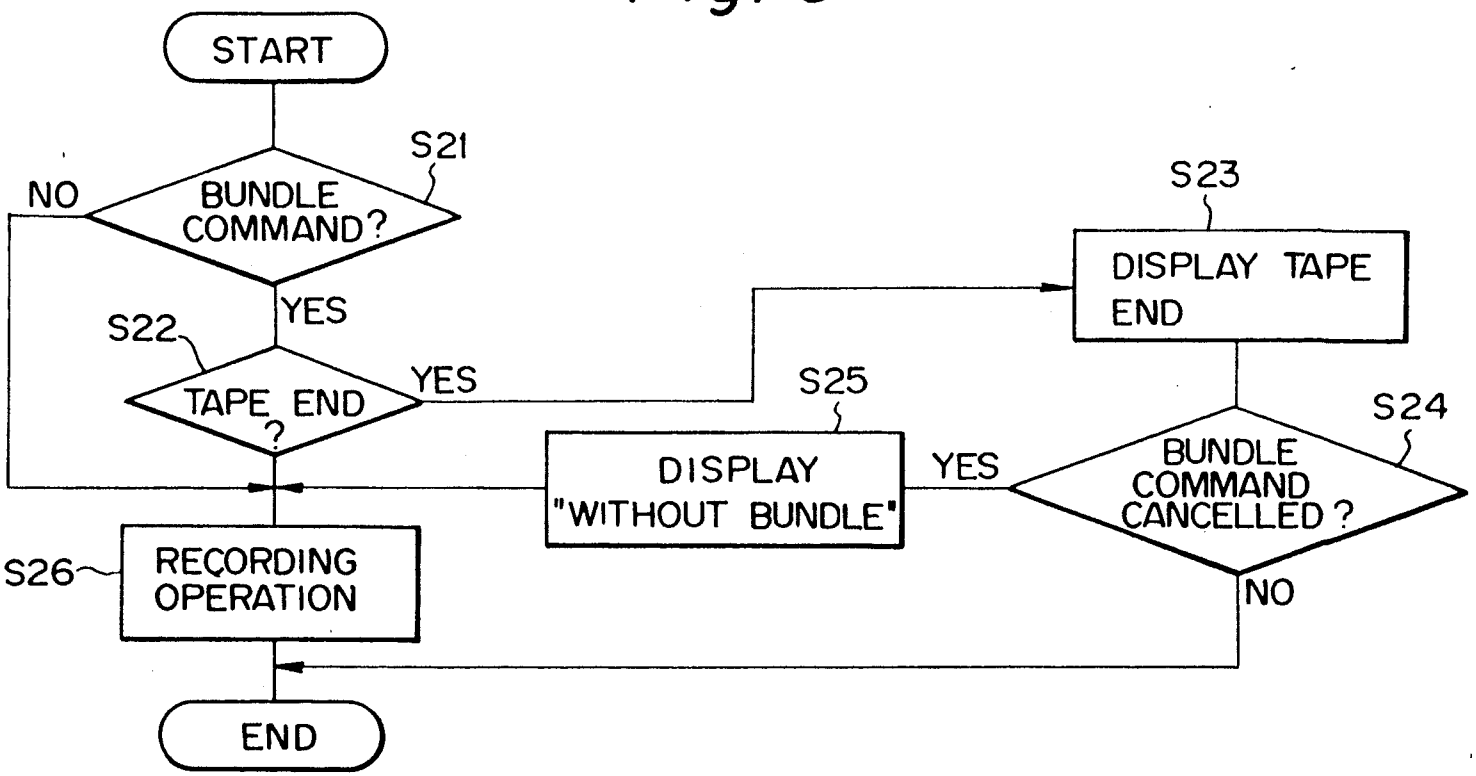
FIG. 9 is a flowchart showing a tape end check subroutine particular to the control system.
Figure 10:
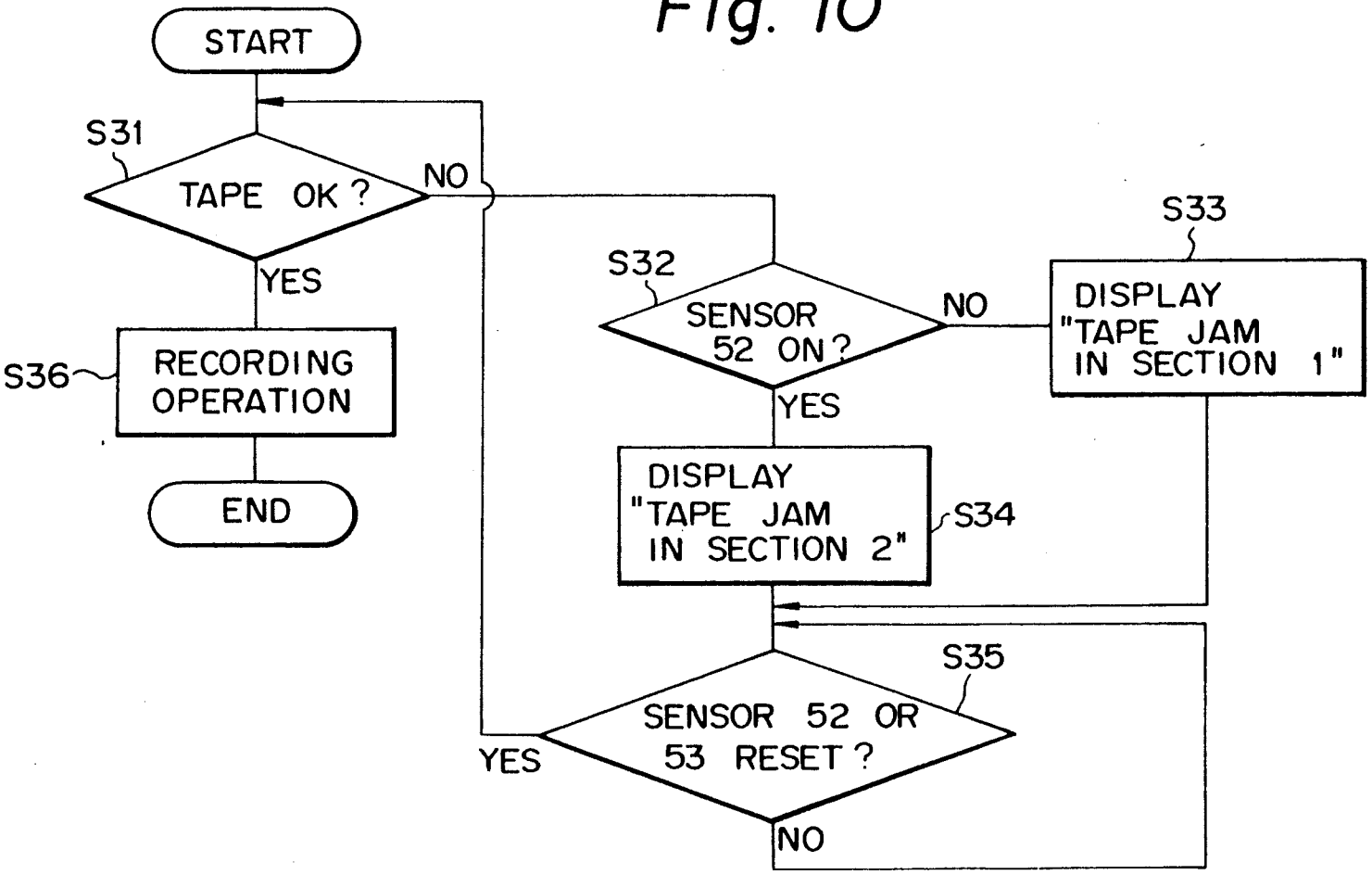
FIG. 10 is a flowchart showing a tape condition check subroutine also particular to the control system.

In the illustrative embodiment, every time the bundle command is fed to the display section 6 or to the control section 33, the control section 33 executes tape check processing such as a tape end check subroutine and a tape condition check subroutine shown in FIGS. 9 and 10, respectively.

Specifically, the tape end check subroutine shown in FIG. 9 begins with a step S21 for determining whether or not a bundle command has been entered. If the answer of the step S21 is YES, whether or not the tape roll 41 has run out of the tape 41*a* is determined with reference to the output of the tape end sensor 50 (S22). If the answer of the step S22 is YES, the control section 33 sends an operation stop command to the control section 7 with the result that a tape end condition is displayed on the display section 6 (S23). Then, whether or not the bundle command has been cancelled is determined (S25). If the answer of the step S25 is YES, a message such as "WITHOUT BUNDLE" appears on the display section 6 (S25). Then, the recording operation is enabled (S26), followed by the previously stated step S5 and successive steps. In this manner, when the tape 41*a* is short despite a bundle command from the control section 7, the control section 33 sends an operation stop command to the control section 7 to interrupt the operation of the copier body 1.

In the tape condition check subroutine shown in FIG. 10, whether or not the tape 41*a* is free from faults is determined on the basis of the outputs of the sensors 52 and 53 (S31). If the answer of the step S31 is NO, whether or not the sensor 52 is ON is determined (S32). If the answer of the step S32 is NO, the control section 33 sends an operation stop command and a display request to the control section 7. As a result, the display section 6 shows that the tape 41*a* has jammed the path in the section 1 (S33). If the answer of the step 32 is YES, the display 6 indicates that the tape 41*a* has jammed the path in the other section 2 (S34). This is followed by a step S35 for determining whether or not the sensor 52 or 53 has been reset (S35). If the answer of the step S35 is YES, the program returns to the step S31. When the tape 41*a* is restored to normal as determined in the step S31, the recording operation is enabled. This is followed by the step S5 and successive steps. As stated above, the control section 33 interrupts the operation of the copier body 1 when the tape 41*a* is in an unusual condition as represented by the output signals of the sensors 52 and 53.

The illustrative embodiment bundles paper sheets P driven out of the copier body 1 by using the tape 41*a*, as described above. Such a finisher is advantageous over conventional finishers in that it is capable of sorting an extremely great amount of paper sheets automatically within a short period of time. The bundled paper sheets are easy to handle and small enough to save the space for storage. Further, the bundled paper sheets can be easily and safely unbundled for reproduction or similar purpose. This kind of finisher will be very useful when it comes to, among others, documents for conference or lecture use which are often bound and then loosened afterwards.

Further, the control section 7 sends a bundle command to the control section 33 in conformity to the operating conditions of the copier body 1. The operating conditions of the copier body 1 are controlled in conformity to the paper discharging condition of the copier body 1 and the operating condition of the paper bundling device 2 (remaining amount of tape 41*a* and fault). This is successful in eliminating incomplete bundles ascribable to lags in the operating timins of the copier body 1 and device 2.

The copier body 1 is inhibited from operating when paper sheets P are left on the tray 31, when the tape 41*a* is short, or when the tape 41*a* is in an unusual condition. This prevents incoming paper sheets from being mixed with paper sheets existing on the tray 31 while eliminating erroneous bundling.

The illustrative embodiment may be modified such that before the recording section 3 begins to operate (S6, FIG. 8), the bundling section 32 is driven to loop the tape 41*a* to allow paper sheets P which will be driven out to sequentially enter the loop. Then, the control section 33 sends an operation stop command to the control section 7 on the basis of the output of the sensor 40 and the bundle command from the control section 7. As a result, the operation of the copier body 1 is interrupted when paper sheets P are left on the tray 31 after the delivery of the bundle command. Further, the control section 33 interrupts the operation of the copier body 1 when the tape 41*a* is short despite the bundle command or when the tape 41*a* is cut or otherwise defective, by referencing the outputs of the sensors 50, 52 and 53.

Figure 11:
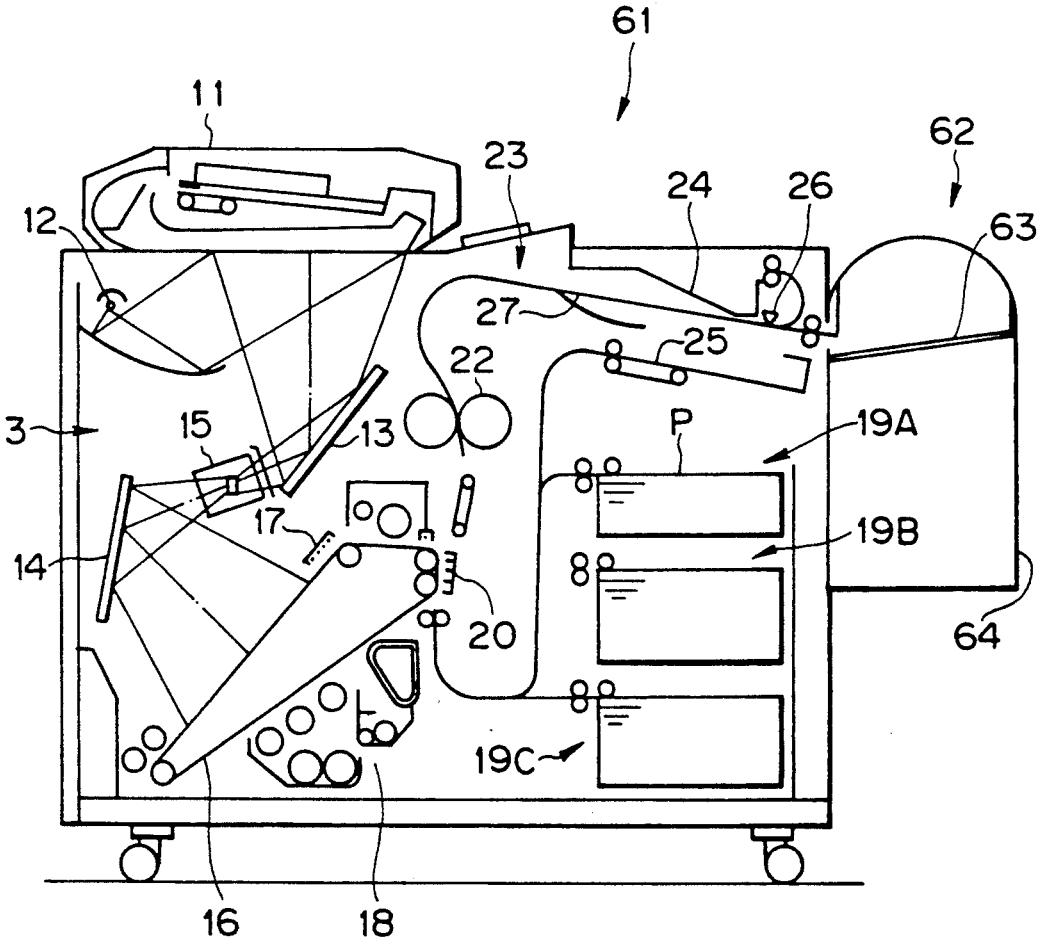
FIG. 11 is a section showing an alternative embodiment of the present invention.
Figure 12:
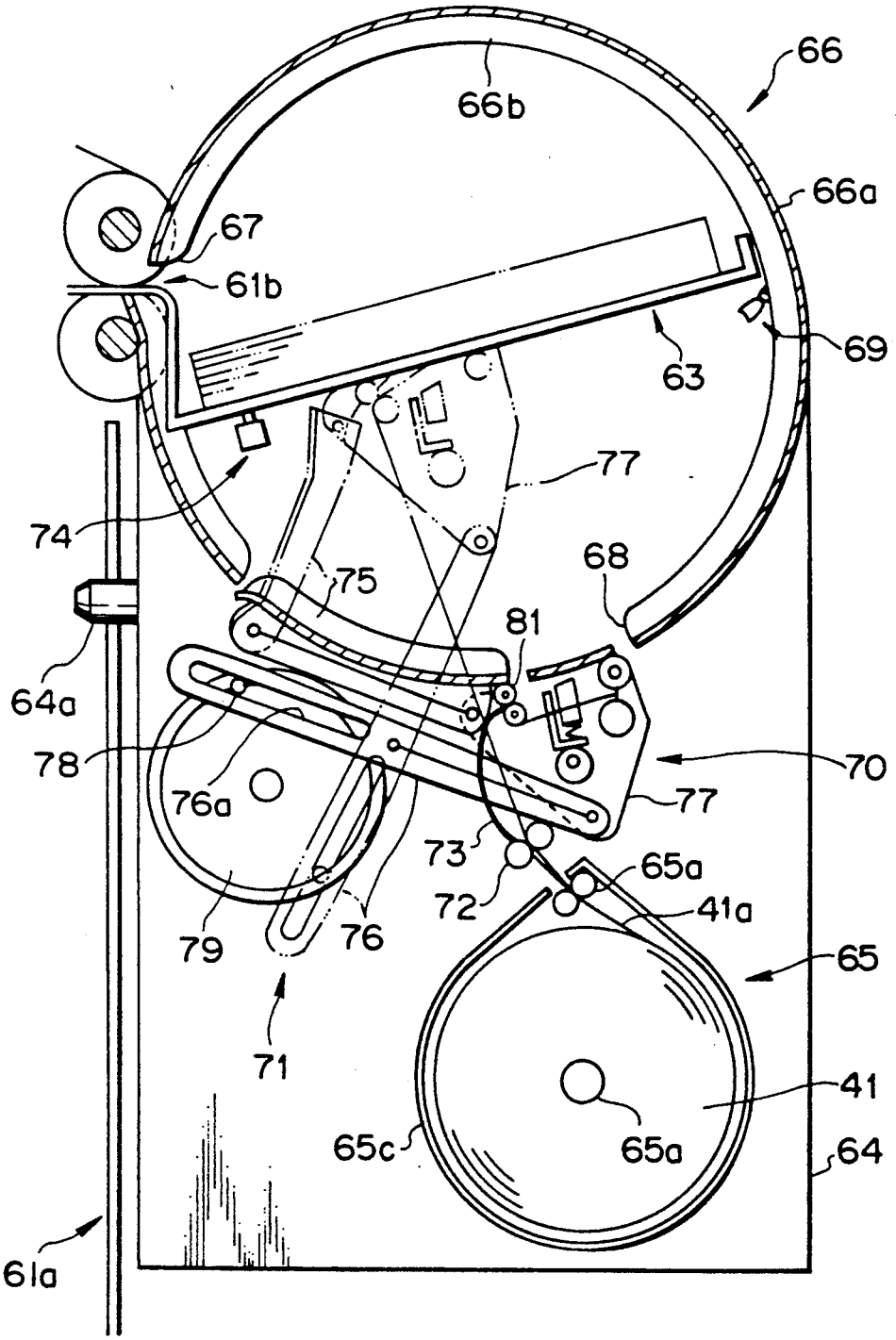
FIG. 12 is a section showing a specific construction of a paper bundling device shown in FIG. 11.

Referring to FIGS. 11 to 13, an alternative embodiment of the present invention will be described. In the figures, the same or similar components and structural elements are designated by like reference numerals, and redundant description will be avoided for simplicity. As shown, a paper bundling device 62 is operatively associated with a copier body 61 and constructed integrally with a copy tray 63 of the latter. Specifically, the paper bundling device 62 has a casing 64 which is provided with a positioning portion 64*a*. The positioning portion 64*a* is engaged with a frame 61*a* included in the copier body 61. A tape cartridge 65 has a casing 65*c*, a support shaft 65*a* supporting a tape roll 41 thereon, and a pay-out roller 65*b* for paying out the tape 41*a* from the roll 41 to the outside of the casing 65*c*. A tape guide 66 has a circular circumferential wall 66*a* surrounding one side portion of the copy tray 63, a pair of side walls 66*b*, a first opening 67 aligned with a paper outlet 61*b* of the copier body 61, and a second opening 68 open toward the tape cartridge 65. An air nozzle 69 blows compressed air into the tape guide 66. A bundling unit 70 cooperates with the air nozzle 69 to loop the tape 41*a* payed out from the tape cartridge 65 along the tape guide 66 and then return the tape 41*a* in a direction for contracting the loop, as will be described. An elevation mechanism 71 drives the bundling unit 70 between two different positions indicated by a solid line and a phantom line in FIG. 12, in interlocked relation to the operation of the bundling unit 70. A revesible roller 72 and a guide member 73 guide the tape 41*a* payed out from the tape cartridge 65 toward the bundling unit 70 which will be located in the solid line position. A sensor 74 is responsive to paper sheets, or copies, stacked on the copy tray 63. These operating sections are controlled by control means, not shown. The elevation mechanism 71 has a first rotatable arm 75 supported by the casing 64 to be rotatable up and down and forming part of the tape guide 66, a second rotatable arm 76 also supported by the casing 64, a mounting plate 77 rotatably supported by the rotating ends of the arms 75 and 76 and mounting the bundling unit 70 thereon, a pin 78 received in a slot 76 formed through the arm 76, and a disk 79 rotatable while supporting the pin 78 in a rotatable manner. The disk 79 causes the arms 75 and 76 to rotate up and down to move the mounting plate 77 back and forth between a phantom line position and a solid line position shown in FIG. 12.

Figure 13A:
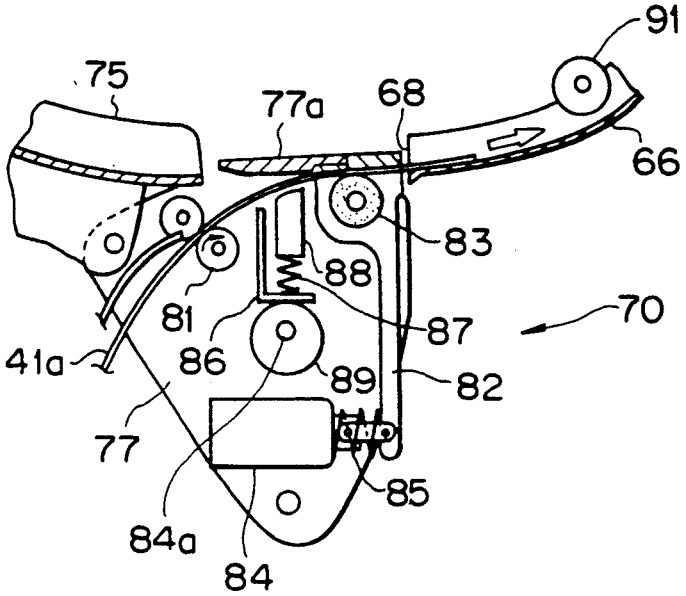
FIGS. 13A to 13D are fragmentary views demonstrating the operation of the alternative embodiment.
Figure 13B:
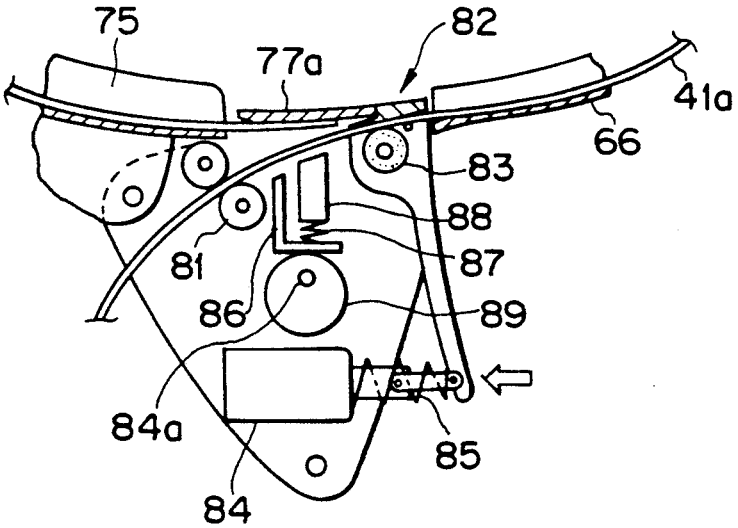
Figure 13C:
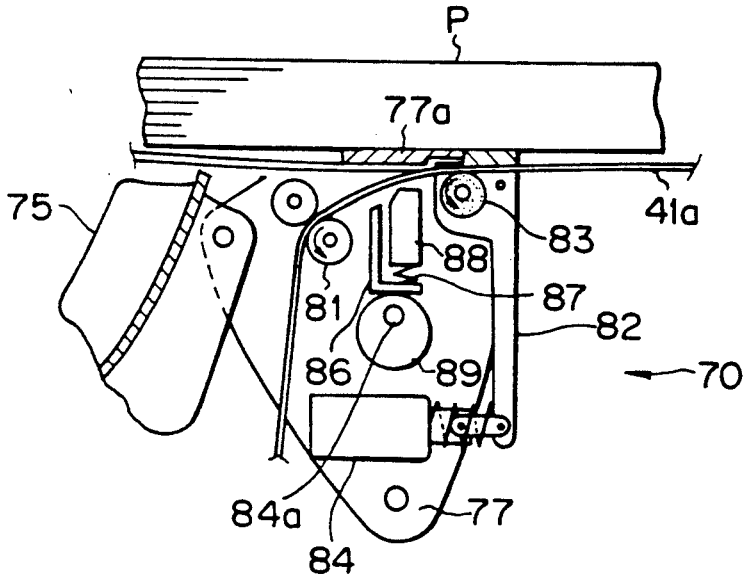
Figure 13D:
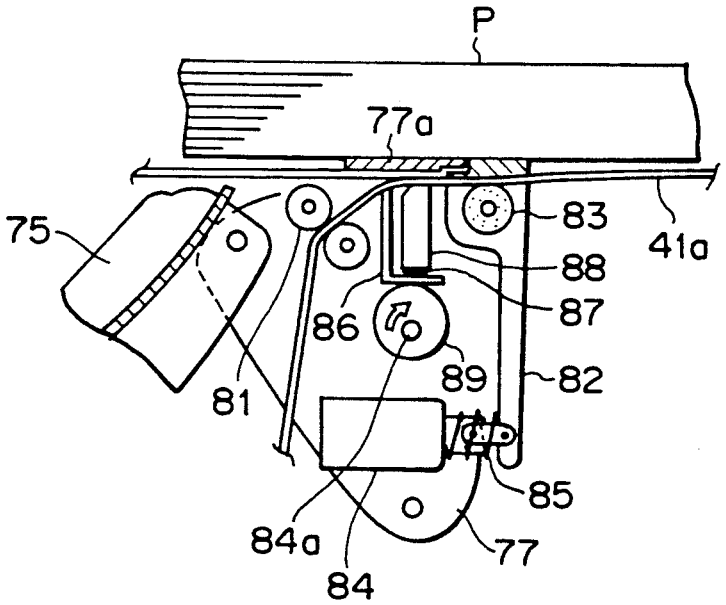

As shown in FIGS. 13A to 13D, in the bundling unit 70, a pay-out roller 81 is mounted on the mounting plate 77 in the vicinity of the opening 68. A clamper 82 is rotatably mounted on the plate 77 and clamps the tape 41*a* in cooperation with a platen 77*a* which forms part of the plate 77. A pay-out roller 83 is journalled to the clamper 82. A solenoid 84 is mounted on the plate 77 to urge the clamper 82 clockwise as viewed in the figures. A spring 85 is preloaded between the clamper 82 and the solenoid 84 for releasing the clamper 82 from the tape 41*a*. A tape cutter 86 is supported by the plate 77 to be movable up and down and has an edge line which intersects the widthwise direction of the tape 41*a*. A heater 88 is connected to the tape cutter 86 by a spring 87. A cam 89 is rotatably mounted on the plate 77 at a shaft portion 84 thereof and moves the tape cutter 86 and heater 88 up and down. Drive means, not shown, drives the rollers 81 and 83, solenoid 84, and cam 89. As shown in FIG. 13A, the tape 41*a* is guided along the tape guide 66 by a guide roller 91.

In operation, the tape 41*a* is payed out from the tape cartridge 65 by the pay-out roller 65*b* and fed by the rollers 71 and 81 toward the tape guide 66. As soon as a complete set of paper sheets driven out of the copier body 61 is stacked on the copy tray 63, the pay-out roller 81 is driven into the tape guide 66 (see FIG. 13A). Then, the tape 41*a* makes one round along the inner periphery of the tape guide 66 to form a loop. As the solenoid 84 is turned on and off, the clamper 82 clamps the end of the tape 41*a* (see FIG. 13B). Thereafter, the disk 79 is rotated to raise the bundling unit 70 until the unit 70 abuts against one side portion of the paper stack P on the copy tray 63. At the same time, the rollers 65*b*, 72 and 81 are reversed to return an excessive portion of the tape 41*a* (see FIG. 13C). At this instant, the air nozzle 69 is retracted to the outside of the tape guide 66. As a result, the paper stack P is bundled at one side portion thereof. The bundling force is freely adjustable by changing the reverse torque of the rollers 72 and 81, i.e., by controlling the power to be fed to a motor which drives such rollers., Subsequently, the cam 89 is rotated to urge the heater 88 against the tape 41*a* to adhere overlapping portions of the tape 41*a*, and the tape cutter 86 abuts against the tape 41*a* (see FIG. 13D). As the reverse rotation of the rollers 72 and 81 continues, the tape cutter 86 cuts the tape 41*a*. Transporting means, not shown, shifts the resulted paper bundle P in the widthwise direction of the tape 41*a*. As a result, the clamper 82 and the tape 42*a* are released from each other. If desired, an arrangement may be made to cause the clamper 82 to move away from the tape 41*a* in the widthwise direction of the latter. The paper bundle may be removed from the tray 63 by hand or may be transported by the transporting means to a predetermined stacking position.

This embodiment, compared to the previous embodiment, allows a paper bundle to be shifted more easily to the front side of the copier body 61 and thereby enhances more rapid handling.

In summary, in accordance with the present invention, paper sheets sequentially driven out of a recorder body to form a stack are bound by a bundling device which uses a strip. Therefore, the present invention implements an image recorder with a bundling device which sorts a great amount of paper sheets rapidly. The bundle paper sheets are easy to handle and can be copied, as desired. Incomplete bundling due to lags in the operation timings of the recorder body and bundling device is eliminated. When paper sheets are left on a tray of the bundling device as indicated by an output of paper sensing means, control means inhibits the recorder body from operating to prevent incoming paper sheets from being mixed with the existing paper sheets. Also, if the strip is short when a bundle command is generated, the control means interrupts the operation of the recorder body to eliminate binding errors. When the strip is in an unusual condition, the control means interrupts the operation of the copier body. This is successful in facilitating the maintenance of the bundling device as well as in eliminating binding errors.

Various modifications will become possible for those skilled in the art after receiving the teachings of the present disclosure without departing from the scope thereof.

What is claimed is:

1. An image recorder capable of bundling a stack of recording sheets each carrying an image thereon, comprising:

recording means for recording images on recording sheets and discharging said recording sheets;

stacking means for stacking said recording sheets discharged from said recording means;

bundling means for bundling said recording sheets stacked by said stacking means by a strip;

paper sensing means for determining whether or not recording sheets have been stacked by said stacking means; and control means responsive to a bundle command for controlling a recording operation of said recording means and a bundling operation of said bundling means, said control means interrupting the recording operation of said recording means when an output of said paper sensing means indicates that recording sheets have been stacked.

2. An image recorder as claimed in claim 1, further comprising strip sensing means for sensing a remaining amount of said strip accommodated in said bundling means, said control means interrupting the recording operation of said recording means when an output of said strip sensing means indicates that the remaining amount of said strip is less than a predetermined amount.

3. An image recorder as claimed in claim 1, further comprising fault sensing means for sensing a fault of said strip accommodated in said bundling means, said control means interrupting the recording operation of said recording means when an output of said fault sensing means is indicative of a fault occurred in said strip.

4. An image recorder as claimed in claim 1, further comprising elevatable discharging means for discharging said recording sheets having been bundled by said bundling means.

5. An image recorder as claimed in claim 1, wherein said recording means comprises a copier body.

6. An image recorder as claimed in claim 5, wherein said bundling means comprises:

a tray for stacking said recording sheets driven out of said copier body;

pay-out means for paying out said strip;

looping means for guiding and looping said strip;

binding means for binding said recording sheets positioned in said loop by said strip; and means for holding said recording sheets in a bound condition even after said binding means is released.

7. An image recorder as claimed in claim 6, wherein said strip comprises a a tape pasted on one side thereof.

8. An image recorder as claimed in claim 7, wherein said pay-out means and said binding means comprises a drive roller and a pinch roller coactive with said drive roller.

9. A paper bundling device for use with an image recorder for bundling a plurality of recording sheets discharged from an outlet of said image recorder, each sheet carrying an image thereon, said device comprising:

loop forming means for forming a loop of a strip material, an inlet formed by said loop opening toward said outlet of said image recorder; and bundling means for bundling by said strip material said sheets transferred into said inlet of said loop of said strip material and stacked and wherein said sheets are transferred into said inlet of said loop of said strip material one by one.

10. A paper bundling device as claimed in claim 9, further comprising:

control means for controlling said loop forming means and said bundling means, such that said loop is formed before one of said sheets which is firstly discharged from said outlet of said image recorder and transferred into said inlet of said loop of said strip material reaches said strip material, and that said sheets are bundled by said strip material after a group of said sheets have been transferred into said inlet of said loop of said strip material and stacked.

11. A paper bundling device for use with an image recorder for bundling a plurality of sheets discharged from an outlet of said image recorder, each carrying an image thereon, said device comprising:

a tray for stacking said sheets discharged from said outlet of said image recorder;

strip guide means adjacent to said outlet of said image recorder for defining a path of movement of a strip material and for guiding a strip material therealong and in a direction of discharge of said sheets to form a loop of said strip material around said tray, said guide means having an opening aligned with said outlet of said image recorder;

loop forming means cooperating with said guide means for forming said loop by feeding said strip material within and along said guide means;

bundling means for bundling said sheets stacked on said tray by said strip material; and control means for controlling said guide means, said loop forming means and said bundling means, such that after said sheets have been stacked on said tray, said loop is formed around said tray and then said sheets are bundled by said strip material.

* * * * *